US005154132A

United States Patent [19]

Brushaber

[11] Patent Number: 5,154,132

[45] Date of Patent: Oct. 13, 1992

[54] MOORING WHIP WITH REMOTE SELECTIVE MOORING LINE RELEASE

[76] Inventor: Donald Brushaber, 221 Hayes Ct., Normandy Beach, N.J. 08739

[21] Appl. No.: 816,764

[22] Filed: Jan. 2, 1992

[51] Int. Cl.[5] ..... B63B 21/00

[52] U.S. Cl. ..... 114/230

[58] Field of Search ..... 114/230; 441/3, 4, 5

[56] References Cited

U.S. PATENT DOCUMENTS 3,120,831 2/1964 Fulton ..... 114/230

5,036,787 8/1991 Rogers ..... 114/230

*Primary Examiner*—Jesus D. Sotelo

*Attorney, Agent, or Firm*—Samuelson & Jacob

[57] ABSTRACT

An improvement in a mooring whip includes a locking cam adjacent the top of the mooring whip for securing a mooring line to the tip of the mooring whip and a release cord attached to the locking cam for selective release of the mooring line for slipping relative to the tip of the mooring whip, the mooring line and the release cord both being directed to a location adjacent the base of the mooring whip for operation remote from the tip of the mooring whip to either bias the boat away from the boat dock upon which the mooring whip is mounted or to enable the boat to be drawn up to the dock selectively for boarding.

11 Claims, 2 Drawing Sheets

MOORING WHIP WITH REMOTE SELECTIVE MOORING LINE RELEASE

The present invention relates generally to the mooring of small boats and pertains, more specifically, to an improvement in mooring whips used to bias a small boat away from the boat dock to which the boat is moored.

Mooring whips have found widespread use in the mooring of small boats where it is desired to secure a small boat to a boat dock while maintaining the boat spaced away from the dock a relatively short distance so as to protect against marring or otherwise damaging the hull of the boat as a result of rubbing or bumping against the dock. A typical mooring whip installation is illustrated in U.S. Pat. No. 3,120,831. Usually, the mooring whip is mounted on a boat dock, a mooring line is attached between a boat and the tip of the mooring whip and the mooring whip is flexed into a bowed configuration to bias the boat away from the dock and thereby protect the hull of the boat against damage from rubbing or bumping against the dock. Since the tip of the mooring whip is remote from the dock, various schemes have been developed for facilitating securing and releasing of the mooring line while assuring that the mooring line is attached in some way at the tip of the mooring whip so that the boat will be biased away from the dock by the mooring whip when moored, yet is moved readily to the dock for boarding.

The present invention provides a convenient arrangement for the selective attachment and release of a mooring line at the tip of a mooring whip from a remote location at the boat dock, adjacent the base where the mooring whip is mounted upon the dock. As such, the improvement of the present invention exhibits several objects and advantages, some of which are summarized as follows: Enables the convenient selective attachment and detachment of a mooring line at the far end of a mooring whip from a remote location at the near end of the mooring whip for increased ease and safety; provides a simple yet effective mechanism which is readily mounted at the far tip of a mooring whip for remote operation from the near base of the mooring whip to selectively attach or detach a mooring line at the tip of the mooring whip and enable flexing of the mooring whip into a bowed configuration for biasing a moored boat away from the boat dock to which the boat is moored, while facilitating selected movement of the boat to the dock for boarding; enables convenient and orderly storage of the portion of the mooring line which lies between the tip of the mooring whip and the base of the mooring whip while the mooring whip is in the bowed configuration; provides a relatively lightweight, simplified mechanism readily carried at the remote tip of the mooring whip without adversely affecting the function of the mooring whip; is adapted readily for use with existing mooring whips; is amenable to economical manufacture in large numbers of consistent high quality for effective use over a relatively long service life.

The above objects and advantages, as well as further objects and advantages, are attained by the present invention which may be described briefly as providing, in a mooring whip for mounting upon a boat dock to facilitate the mooring of a boat alongside the dock, the mooring whip including an elongate resiliently flexible pole having a near end at the dock and a far end remote from the dock, and mooring line attachment means at the far end of the pole for attaching the far end to a mooring line secured to the boat, the pole being capable of bowing from an unbowed configuration into a bowed configuration to bias the attached mooring line, and the boat secured to the mooring line, away from the dock, the improvement wherein the mooring line attachment means includes a selectively releasable securing means at the far end of the pole for remote operation from the near end of the pole to selectively secure and release the line at the far end, the securing means comprising: a frame affixed to the pole adjacent the far end of the pole; a mooring line redirecting means mounted on the frame for directing the mooring line along a direction extending from the near end of the pole toward the far end of the pole, and then from the far end of the pole toward the boat; a first clamping jaw on the frame and located between the mooring line redirecting means and the near end of the pole; a mooring line locking member mounted on the frame for movement relative to the first clamping jaw, the locking member including a second clamping jaw opposed to the first clamping jaw and movable with the locking member between a locked position, wherein the second clamping jaw is in relatively close proximity with the first clamping jaw for locking the mooring line in place between the first clamping jaw and the second clamping jaw, and an unlocked position, wherein the second clamping jaw is spaced away from the first clamping jaw a distance sufficient to free the mooring line for movement between the first clamping jaw and the second clamping jaw; resilient biasing means coupled between the frame and the locking member for biasing the locking member into the locked position such that upon pulling on the mooring line in the direction from the far end of the pole toward the near end of the pole, the mooring line will slip between the first and second clamping jaws and the pole will be flexed into the bowed configuration, and upon discontinuing pulling of the mooring line in the direction from the far end toward the near end of the pole the mooring line will be locked in place between the first and second clamping jaws; a release cord attached to the locking member and extending toward the near end of the pole, the release cord having an operating portion adjacent the near end of the pole; and release cord redirecting means mounted on the frame between the locking member and the mooring line redirecting means for directing the release cord along a direction extending from the operating portion located adjacent the near end of the pole toward the far end of the pole and then in the opposite direction from the far end toward the near end of the pole to the locking member such that grasping the operating portion of the release cord remote from the far end of the pole, adjacent the near end of the pole, and pulling upon the operating portion of the release cord in the direction from the far end toward the near end of the pole will move the locking member from the locked position to the unlocked position to release the mooring line from between the first and second clamping jaws and enable the pole to resume the unbowed configuration, thereby discontinuing the biasing force on the boat and releasing the boat for movement toward the dock.

The invention will be understood more fully, while still further objects and advantages will become apparent, in the following detailed description of a preferred embodiment of the invention illustrated in the accompanying drawing, in which.

Figure 1:
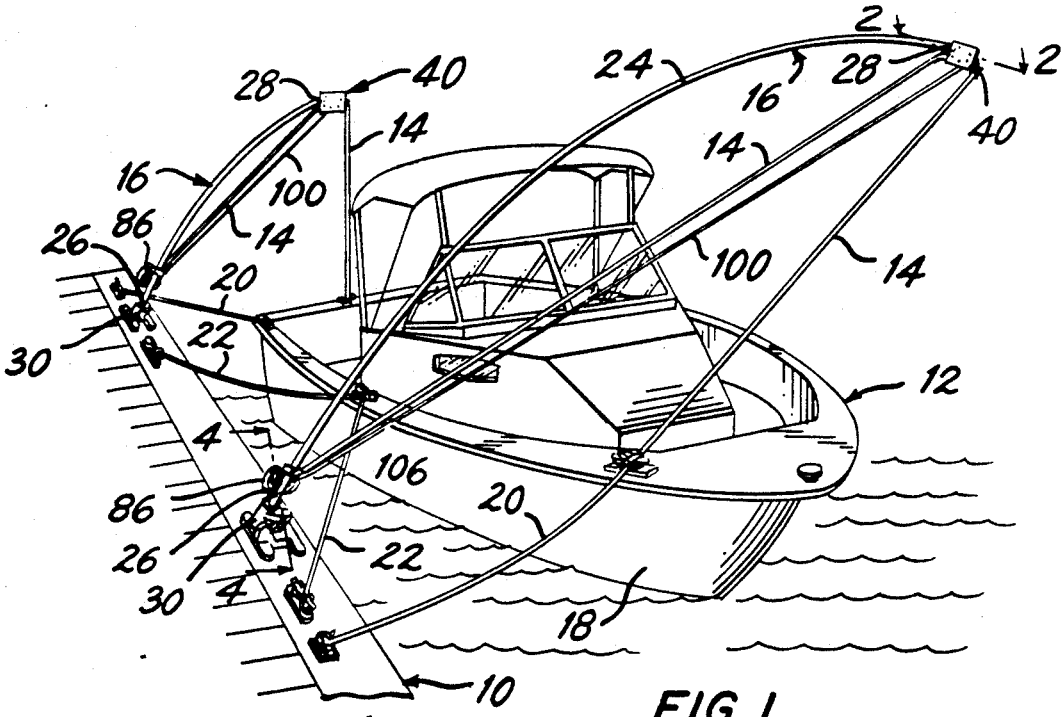
FIG. 1 is a pictorial illustration of apparatus constructed in accordance with the present invention, installed at a boat dock and shown with a boat biased away from the dock.

Referring now to the drawing, and especially to FIG. 1 thereof, a boat dock is illustrated at 10 and a small boat 12 is moored to the dock 10 through the use of a pair of mooring lines 14 attached to a corresponding pair of mooring whips 16. The mooring whips 16 are flexed into a bowed configuration so that the mooring lines 14 pull outwardly away from the dock 10 to bias the boat 12 away from the dock 10 and thereby preclude damage to the hull 18 of the boat 12, which otherwise could result from rubbing or bumping against the dock 10. Supplemental lines 20 and 22 assist in the proper mooring of the boat 12, all in a manner now well known in boat mooring techniques. Each mooring whip 16 includes a resiliently flexible pole 24, usually constructed of durable and weather resistant material, such as a fiberglass reinforced polyester, extending between a near end 26 and a far end 28. A mounting base 30 is affixed to the dock 10 and receives the near end 26 of the pole 24 to affix the mooring whip 16 in place on the dock 10. The mounting base 30 enables the mooring whip 16 to be adjusted about an axis which extends generally parallel to the dock 10, and generally parallel to the fore-and-aft direction along the boat 12, so that the mooring whip 16 may be fixed at a selected position between a generally vertical position and a position where the mooring whip 16 projects outwardly from the dock 10.

Figure 2:
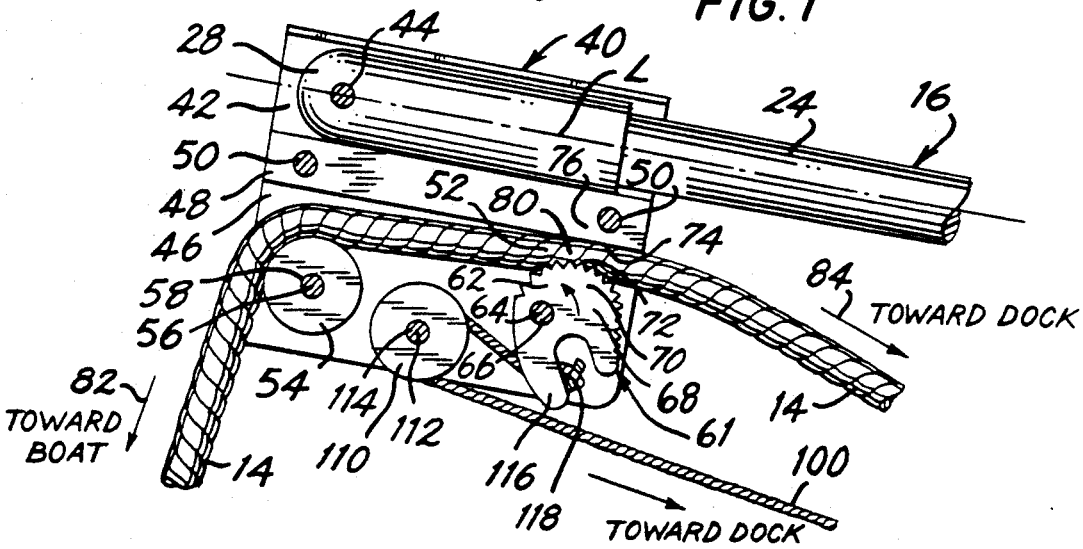
FIG. 2 is an enlarged, partially sectioned fragmentary view of a portion of the apparatus, as viewed in the direction indicated by line 2—2 in FIG. 1.
Figure 3:
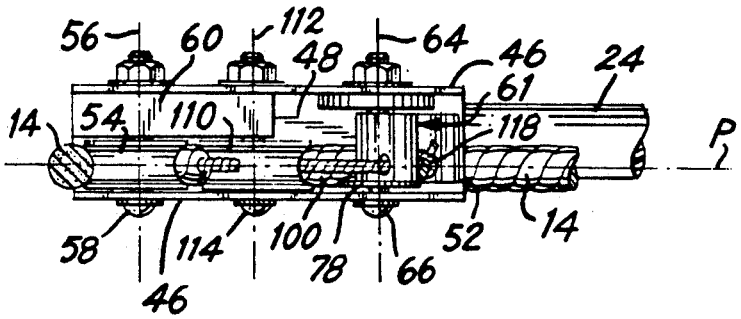
FIG. 3 is a bottom plan view of the fragment of FIG. 2.

As best seen in FIGS. 2 and 3, mooring line 14 is attached and secured adjacent the far end 28 of the pole 24 of the mooring whip 16 by attachment means including selectively releasable securing means shown in the form of a device 40. Device 40 includes a frame 42 affixed to the pole 24, at the far end 28 thereof, by means of a bolt-and-nut assembly 44 which passes through the pole 24 adjacent the far end 28, transverse to the longitudinal axis L of the pole 24, to secure the frame 42 upon the pole 24. The use of nut-and-bolt assembly 44 enables device 40 to be attached selectively to existing mooring whips. Frame 42 has opposite side members 46 and a longitudinally extending bar 48, all secured together by further bolt-and-nut assemblies 50 to establish a passage 52 for the mooring line 14. Mooring line 14 extends from the near end 26 of the pole 24 through the passage 52 and then to the boat 12. A mooring line redirecting means in the form of a pulley 54 essentially reverses the direction of the mooring line 14 as the mooring line 14 is directed from the near end 26 toward the pulley 54 and then to the boat 12. Pulley 54 is mounted on the frame 42 for rotation about a fixed lateral axis 56 adjacent the far end 28 of pole 24 by an axle 58 affixed to the frame 42 and is located laterally by a spacer 60 placed between the pulley 54 and one of the side members 46 of the frame 42 so that the mooring line 14 is largely confined for longitudinal movement along the passage 52, closely adjacent to bar 48.

Figure 4:
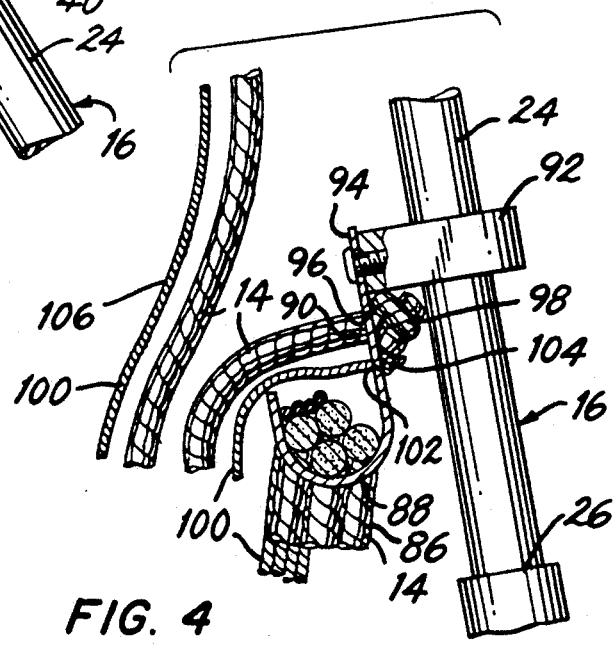
FIG. 4 is an enlarged, partially sectioned fragmentary view of another portion of the apparatus, as viewed in the direction indicated by line 4—4 in FIG. 1.

A mooring line locking member 61 is mounted on the frame 42, longitudinally between the pulley 54 and the near end 26 of the pole 24, and includes a locking cam 62 mounted for pivotal movement about a fixed lateral axis 64, by means of an axle 66 secured to the frame 42 and located between the axle 58 and the near end 26 of the pole 24. Locking cam 62 includes an eccentric element 68 carrying a clamping jaw 70 having a serrated surface 72 located opposite another clamping jaw 74 provided by a portion 76 of the bar 48. A coil spring 78 is coupled between the locking cam 62 and the frame 42 and biases the locking cam 62 in a counterclockwise direction, as viewed in FIG. 2, to bias the clamping jaw 70 toward the opposite clamping jaw 74 and into a locked position wherein the clamping jaws 70 and 74 are in close proximity so as to grip the mooring line 14 at 80 and clamp the mooring line 14 in place adjacent the far end 28 of the pole 24. Any further pulling on the mooring line 14 by the boat 12, in the direction of the arrow 82, will tend to tighten the grip of the clamping jaw 70 on the mooring line 14 by virtue of the eccentric element 68. However, pulling of the mooring line 14 in the opposite direction, as indicated by the arrow 84, will allow the mooring line 14 to slip between the clamping jaws 70 and 74, again by virtue of the eccentric element 68, so that the mooring line 14 can be pulled from a location adjacent the near end 26 of the pole 24 to bow the pole 24 and bias the boat 12 away from the dock 10, as illustrated in FIG. 1. Once the mooring whip 16 is fully bowed into the bowed configuration illustrated in FIG. 1, and projects outwardly from the dock 10, as shown, the near portion of the mooring line 14 may be coiled into a compact and orderly arrangement in the form of coil 86, and the coil 86 may be placed upon a hook-like holder 88 affixed to the pole 24 adjacent the near end 26 of the pole 24, as best seen in FIG. 4. The end 90 of the mooring line 14 adjacent the near end 26 of the pole 24 is coupled to the pole 24 by means of coupling 92 secured to the pole 24 adjacent the near end 26. Coupling 92 includes a bracket 94 having a hole 96 through which the mooring line 14 is threaded and then knotted at 98.

Figure 5:
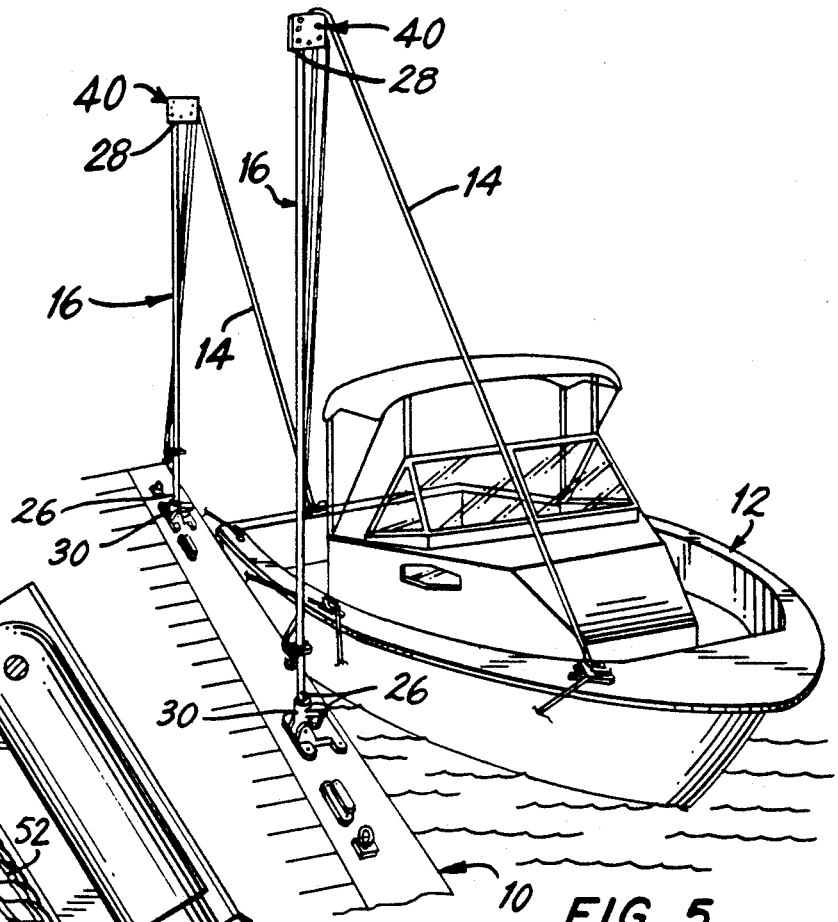
FIG. 5 is a pictorial view similar to FIG. 1, but with the boat moved to the dock for boarding.
Figure 6:
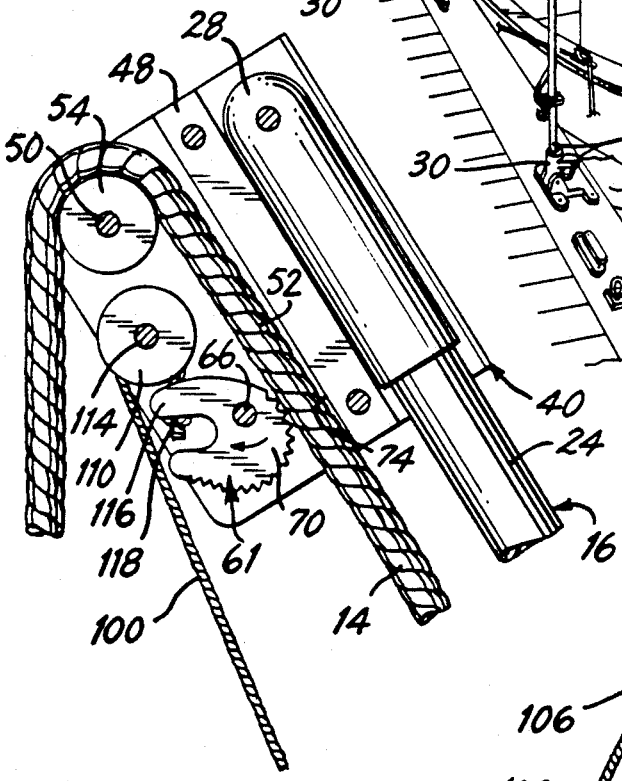
FIG. 6 is an enlarged, partially sectioned fragmentary view similar to FIG. 2, but with component parts in another operating position.

When it is desired to release the outward biasing force of the mooring whips 16 and bring the boat 12 to the dock 10 for boarding, as illustrated in FIG. 5, the grip of the clamping jaws 70 and 74 on the mooring line 14 is released from a remote location adjacent the near end 26 of the pole 24. Thus, a release cord 100 is coupled to the bracket 94 of coupling 92 by virtue of being threaded through another hole 102 in the bracket 94 and being knotted at 104. Release cord 100 includes an operating portion 106 adjacent near end 26 of pole 24 and extends from the operating portion 106 in the direction along the pole 24 from the near end 26 toward the far end 28 to pass around a second pulley 110 which serves as a release cord redirecting means to redirect the release cord 100 to a reverse direction, in which reverse direction the release cord 100 extends to the locking cam 62. Pulley 110 is mounted for rotation about a transverse axis 112 by axle 114 located longitudinally between the axles 58 and 66. A lever 116 projects from the locking cam 62 and the release cord 100 is secured to the lever 116 at 118 so that upon grasping the operating portion 106 of the release cord 100 and pulling the release cord 100 in the direction from the far end 28 toward the near end 26 of the pole 24, the locking cam 62 will be rotated in a clockwise direction, as seen in FIG. 6, against the biasing force of the coil spring 78, and moved to the unlocked position, illustrated in FIG. 6, where the clamping jaws 70 and 74 are spaced from one another a distance sufficient to release the grip of the clamping jaws 70 and 74, enabling the mooring line 14 to pass freely through passage 52. As the mooring line 14 is fed from coil 86 toward passage 52, the pole 24 will return to the relaxed, unbowed configuration illustrated in FIG. 5 and enough slack is provided in the mooring line 14 to enable the mooring whip 16 to be moved toward a vertical position and the boat 12 to be drawn up to the dock 10 for boarding. In this manner, both the securement and the release of the mooring line 14 adjacent the far end 28 of the pole 24 are accomplished with ease from the remote location adjacent the near end 26 of the pole 24, for safety and convenience in using the mooring whips 16. It is noted that the relative location and arrangement of the axles 58, 66 and 114 places the mooring line 14 and the release cord 100 essentially in the same plane P (see FIG. 3) and maintains both the mooring line 14 and the release cord 100 in the same plane P within the frame 42. That relationship assures proper operation without fouling even under the most demanding conditions encountered during service.

It will be seen that the improvement of the present invention attains the objects and advantages summarized above, namely: Enables the convenient selective attachment and detachment of a mooring line at the far end of a mooring whip from a remote location at the near end of the mooring whip for increased ease and safety; provides a simple yet effective mechanism which is readily mounted at the far tip of a mooring whip for remote operation from the near base of the mooring whip to selectively attach or detach a mooring line at the tip of the mooring whip and enable flexing of the mooring whip into a bowed configuration for biasing a moored boat away from the boat dock to which the boat is moored, while facilitating selected movement of the boat to the dock for boarding; enables convenient and orderly storage of the portion of the mooring line which lies between the tip of the mooring whip and the base of the mooring whip while the mooring whip is in the bowed configuration; provides a relatively lightweight, simplified mechanism readily carried at the remote tip of the mooring whip without adversely affecting the function of the mooring whip; is adapted readily for use with existing mooring whips; is amenable to economical manufacture in large numbers of consistent high quality for effective use over a relatively long service life.

It is to be understood that the above detailed description of a preferred embodiment of the invention is provided by way of example only. Various details of design and construction may be modified without departing from the true spirit and scope of the invention as set forth in the appended claims.

The embodiments of the invention in which in exclusive property or privilege is claimed are defined as follows:

1. In a mooring whip for mounting upon a boat dock to facilitate the mooring of a boat alongside the dock, the mooring whip including an elongate resiliently flexible pole having a near end at the dock and a far end remote from the dock, and mooring line attachment means at the far end of the pole for attaching the far end to a mooring line secured to the boat, the pole being capable of bowing from an unbowed configuration into a bowed configuration to bias the attached mooring line, and the boat secured to the mooring line, away from the dock, the improvement wherein the mooring line attachment means includes a selectively releasable securing means at the far end of the pole for remote operation from the near end of the pole to selectively secure and release the line at the far end, the securing means comprising:

a frame affixed to the pole adjacent the far end of the pole;

a mooring line redirecting means mounted on the frame for directing the mooring line along a direction extending from the near end of the pole toward the far end of the pole, and then from the far end of the pole toward the boat;

a first clamping jaw on the frame and located between the mooring line redirecting means and the near end of the pole;

a mooring line locking member mounted on the frame for movement relative to the first clamping jaw, the locking member including a second clamping jaw opposed to the first clamping jaw and movable with the locking member between a locked position, wherein the second clamping jaw is in relatively close proximity with the first clamping jaw for locking the mooring line in place between the first clamping jaw and the second clamping jaw, and an unlocked position, wherein the second clamping jaw is spaced away from the first clamping jaw a distance sufficient to free the mooring line for movement between the first clamping jaw and the second clamping jaw;

resilient biasing means coupled between the frame and the locking member for biasing the locking member into the locked position such that upon pulling on the mooring line in the direction from the far end of the pole toward the near end of the pole, the mooring line will slip between the first and second clamping jaws and the pole will be flexed into the bowed configuration, and upon discontinuing pulling of the mooring line in the direction from the far end toward the near end of the pole the mooring line will be locked in place between the first and second clamping jaws;

a release cord attached to the locking member and extending toward the near end of the pole, the release cord having an operating portion adjacent the near end of the pole; and release cord redirecting means mounted on the frame between the locking member and the mooring line redirecting means for directing the release cord along a direction extending from the operating portion located adjacent the near end of the pole toward the far end of the pole and then in the opposite direction from the far end toward the near end of the pole to the locking member such that grasping the operating portion of the release cord remote from the far end of the pole, adjacent the near end of the pole, and pulling upon the operating portion of the release cord in the direction from the far end toward the near end of the pole will move the locking member from the locked position to the unlocked position to release the mooring line from between the first and second clamping jaws and enable the pole to resume the unbowed configuration, thereby discontinuing the biasing force on the boat and releasing the boat for movement toward the dock.

2. The invention of claim 1 wherein the mooring line redirecting means includes a pulley mounted for rotation on the frame.

3. The invention of claim 1 wherein the release cord redirecting means includes a pulley mounted for rotation on the frame.

4. The invention of claim 1 wherein the mooring line redirecting means includes a first pulley mounted for rotation on the frame adjacent the far end of the pole, and the release cord redirecting means includes a second pulley mounted for rotation on the frame between the first pulley and the near end of the pole such that the mooring line and the release cord extend generally in the same plane.

5. The invention of claim 1 wherein the locking member comprises a cam mounted on the frame for pivotal movement between the locked position and the unlocked position about a fixed axis located between the release cord redirecting means and the near end of the pole.

6. The invention of claim 5 wherein the second clamping jaw is located on the cam.

7. The invention of claim 6 including serrations on the second clamping jaw for gripping the mooring line when the cam is in the locked position.

8. The invention of claim 6 including a lever projecting from the cam, the release cord being attached to the lever.

9. The invention of claim 1 including mooring line coupling means located adjacent the near end of the pole for coupling the mooring line to the pole adjacent the near end of the pole.

10. The invention of claim 1 including release cord coupling means located adjacent the near end of the pole for coupling the release cord to the pole adjacent the near end of the pole.

11. The invention of claim 1 including a holder affixed to the pole adjacent the near end of the pole for holding the mooring line in a compact stored condition when the pole is in the bowed configuration.

* * * * *